US005516419A

United States Patent [19]

Phan et al.

[11] Patent Number: 5,516,419

[45] Date of Patent: May 14, 1996

[54] HARD IRON PLATING OF ALUMINUM/ALUMINUM ALLOYS USING SULFAMATE/SULFATE SOLUTIONS

[75] Inventors: Nguyet H. Phan, Los Angeles; Sue Troup-Packman, Calabasas, both of Calif.

[73] Assignee: Hughes Aircraft Company, Los Angeles, Calif.

[21] Appl. No.: 249,422

[22] Filed: May 26, 1994

[51] Int. Cl.[6] ..... C23C 28/02; C23C 20/00; C25D 3/56; C25D 3/20

[52] U.S. Cl. ..... 205/148; 205/187; 205/258; 205/259; 205/270; 106/1.27

[58] Field of Search ..... 205/148, 187, 205/270, 258, 259

[56] References Cited

U.S. PATENT DOCUMENTS

| | | | |
|---|---|---|---|
| 1,729,607 | 10/1929 | Benzzenberger | 205/148 |
| 3,098,803 | 7/1963 | Godycki et al. | 205/187 |
| 3,616,290 | 10/1971 | Natick et al. | 205/259 |
| 4,221,639 | 9/1980 | Ninagawa et al. | 204/26 |

OTHER PUBLICATIONS

Brownlow, Electroplating Bath for Iron, IBM Tech. Dis. Bull. 6(1), Jun. 1963, p. 6.

Hawley's Condensed Chemical Dictionary, 11th ed. (1987), [no month] p. 101.

Beach, Iron Plating, May 1956, pp. 616–617.

Grant & Hackh's Chemical Dictionary, 5th ed. (1987), [no month] p. 538.

Bartelson et al., electroplating of Ni–Fe Films, IBM Tech. Dis. Bull. 3(2), Jul. 1960, p. 63.

O. J. Klingenmaier, "Hard Iron Plating of Aluminum Pistons", Plating, pp. 741–746 (Aug. 1974).

R. H. Williams, "Iron Plating", in *Metal Finishing*, Michael Murphy, Ed., pp. 223, 224, 226 (Jan. 1992).

*Primary Examiner*—John Niebling
*Assistant Examiner*—Edna Wong
*Attorney, Agent, or Firm*—V. D. Duraiswamy; W. K. Denson-Low

[57] ABSTRACT

Aluminum and aluminum alloy parts, such as pistons, are electroplated with iron employing a ferrous electroplating solution. The solution comprises (a) ferrous iron having a concentration ranging from about 0.65 to 2.0 Moles of $Fe^{2+}$ per liter of solution; (b) at least one anion selected from the group consisting of sulfamate and ammonium sulfate and associated with the $Fe^{2+}$ ions; (c) a reducing agent, such as ascorbic acid, in an amount sufficient to prevent oxidation of $Fe^{2+}$ to $Fe^{3+}$; (d) $Cl^-$ anion in an amount sufficient to promote dissolution of the iron anode; and (e) a wetting agent in an amount sufficient to prevent pitting of the aluminum cathode. The ferrous electroplating bath of the present invention permits plating of relatively thick layers of iron on aluminum, typically on the order of about 0.6 to 2 mils (0.0015 to 0.0051 cm), with a microhardness of at least about 40 (Rockwell C scale).

22 Claims, No Drawings

HARD IRON PLATING OF ALUMINUM/ALUMINUM ALLOYS USING SULFAMATE/SULFATE SOLUTIONS

CROSS-REFERENCE TO RELATED APPLICATION

The present application is related to application Ser. No. 07/959,881, filed Oct. 13, 1992, which discloses the iron plating process using ferrous ammonium sulfate solution and an activation method for preparation of the aluminum surface prior to plating. In the present application, a novel iron electroplating solution is provided, which enables a higher operating current density range and a wider operating temperature range to deposit coating with acceptable microhardness (greater than 40 Rockwell C).

BACKGROUND OF THE INVENTION

1. Field of the Invention

The present invention relates to the plating of aluminum and aluminum alloys, and, more particularly, to the plating of 390 aluminum alloys with iron.

2. Description of Related Art

In the use of aluminum internal combustion engines with aluminum pistons for vehicles, it is essential that either the piston or the cylinder bore be coated with another metal harder than aluminum to prevent piston skirt scuffing during cold starts. Commonly, an iron coating is plated onto the surface of the aluminum pistons, generally employing a copper undercoat.

In one process, copper cyanide and iron chloride baths are used in the plating. Copper cyanide is a highly toxic and tightly regulated material. The iron chloride bath is also a highly toxic and extremely corrosive bath that is very destructive to the equipment around it.

An alternative approach is to insert an iron sleeve into the cylinder bore. Still another approach is to coat the inside of the bore with a suitable metal alloy by thermal spray coating processes and then re-machining the bore. These approaches are estimated to be 8 to 14 times as expensive as piston plating.

It is desired to provide a method, preferably inexpensive, for plating aluminum pistons with an acceptable iron coating that will pass all the required adhesion, hardness, and abrasion tests without using highly toxic or hazardous substances.

SUMMARY OF THE INVENTION

In accordance with the invention, a ferrous electroplating bath for plating an aluminum cathode with iron in the presence of an iron anode comprises:

(a) ferrous iron having a concentration ranging from about 0.65 to 2.0 Moles of $Fe^{2+}$ per liter of solution;

(b) at least one anion selected from the group consisting of sulfamate and ammonium sulfate and associated with the $Fe^{2+}$ ion;

(c) a reducing agent in an amount sufficient to prevent oxidation of $Fe^{2+}$ to $Fe^{3+}$;

(d) $Cl^-$ anion in an amount sufficient to promote dissolution of the iron anode; and (e) a wetting agent in an amount sufficient to prevent bubbles of hydrogen gas from adhering to the aluminum cathode.

The electroplating is performed by immersing the iron anode and the aluminum cathode in the ferrous electroplating solution and applying a current density ranging from about 35 to 110 Amp/ft$^2$ for a time sufficient to plate a layer of iron on the aluminum cathode to a desired thickness.

The iron electroplating bath of the present invention permits plating of relatively thick layers of iron on aluminum, typically on the order of about 0.6 to 2 mils (0.0015 to 0.0051 cm), with a microhardness of at least about 40 (Rockwell C scale).

DESCRIPTION OF THE PREFERRED EMBODIMENTS

The electroplating bath formulation of the present invention employs ferrous sulfamate, ferrous ammonium sulfate or a mixture thereof and electrodeposits a hard iron coating having a thickness ranging from about 0.6 to 2 mils (0.0015 to 0.0051 cm) and microhardness of about 40 to 54 Rockwell C on aluminum or aluminum alloy parts.

The new electroplating formulation of an environmentally-sound iron plating solution is very beneficial in terms of its high solubility, solution stability, and non-toxic nature. The formulation of the invention makes it possible to electrodeposit hard iron with desired thickness, microhardness and low-stress cracking using a relatively non-hazardous plating process.

In preparing the aluminum or aluminum alloy piston or part for iron plating, the part is first cleaned to remove grease and oils, typically employing a non-etching, hot alkaline cleaner. Examples of such cleaners include commercially available products, such as dishwashing compositions, CHEMIZID 740, available from Allied-Kelite, and ALKANOX, available from VWR Scientific. The immersion time typically ranges from about 15 seconds to 1 minute. If the part is very oily or greasy, a solvent degrease step (involving an ultrasonic cleaning procedure) may be inserted prior to the alkaline cleaning step.

The cleaned part is then rinsed in cold running water, acid-etched for 10 seconds to remove aluminum oxides, and rinsed again with cold water. A well-known acid etch suitably employed in the practice of the invention for removing aluminum oxides comprises about 50% water, 25% sulfuric acid, 24% nitric acid, and 1% hydrofluoric acid. However, any of the acid etches known for removing aluminum oxides may be employed, such as a solution of ammonium bifluoride double salt, commercially available as ARP 28 from Allied-Kelite.

The part is now ready for plating. In the first plating step, the part is immersed in a zincate bath, such as a proprietary immersion zincate solution available from Allied Kelite under the tradename ARP 302 Zincate. The bath is made up according to the manufacturer's directions and is operated at room temperature. Immersion time is typically 30 seconds.

The zincate layer is essentially transitory, and is used to prevent aluminum oxides from reforming after the acid etch step. This layer is lost during the subsequent electroless nickel plating, described in greater detail below.

The zincate-coated part is rinsed with cold running water and then immersed in an electroless nickel bath, such as a proprietary electroless nickel solution available from Allied-Kelite under the tradename Electroless Nickel 794. Any of the known electroless nickel solutions may be employed in the practice of the invention. The bath is made up according to the manufacturer's directions and is heated to 185° to 200° F. (85° to 93.3° C.), and preferably about 190° F. (87.8° C.). Immersion time is typically about 5 minutes and results in a thickness of about 0.00005 inch (0.00013 cm). An immersion time of about 1 minute results in a thickness of about 0.000003 inch (0.0000076 cm), which is also useful in the practice of the invention.

The thickness of the nickel coating may range from about 0.000002 to 0.0015 inch (0.000005 to 0.0038 cm) to provide a layer to which the subsequently-plated iron layer will adhere. A nickel thickness less than about 0.000002 inch may not provide sufficient adherence of the iron layer thereto, and a nickel thickness greater than about 0.0015 inch may be too brittle.

The nickel-plated part is rinsed with cold running water and are next immersed in a novel iron plating bath, the composition of which includes an aqueous solution of ferrous sulfamate, ferrous ammonium sulfate, or a mixture thereof. During electroplating, the aluminum part is made the cathode and an iron anode is used to complete the circuit.

The composition of the iron electroplating bath of the invention comprises:

(a) ferrous iron having a concentration ranging from about 0.65 to 2.0 Moles per liter of $Fe^{2+}$ ion;

(b) at least one anion selected from the group consisting of sulfamate and ammonium sulfate and associated with the $Fe^{2+}$ ion;

(c) a reducing agent in an amount sufficient to prevent oxidation of $Fe^{2+}$ to $Fe^{3+}$;

(d) $Cl^-$ anion in an amount sufficient to promote dissolution of the iron anode; and (e) a wetting agent in an amount sufficient to prevent pitting of the aluminum cathode by preventing adherence of hydrogen gas bubbles to the aluminum cathode.

The concentration of ferrous ion ranges from about 0.65 to 2.0 Moles of $Fe^{2+}$ per liter of plating solution, in order to achieve the combination of thick iron deposits (0.6 to 2 mils) and high hardness (at least 40 Rockwell C). Preferably, the concentration of ferrous ion ranges from about 1.4 to 2.0 Moles of $Fe^{2+}$ per liter of plating solution, in order to realize higher deposition rates. For example, within the preferred range, a thickness of plated iron of 1 mil is achieved in 20 minutes at a current density of 80 amps/$ft^2$.

The anion associated with ferrous cation consists essentially of at least one anion selected from the group consisting of sulfamate and ammonium sulfate. Most preferred is a mixture of sulfamate and ammonium sulfate anions, due to the stability of the plating bath and the comparative ease of achieving microhardness values exceeding 40 Rockwell C. Next preferred is the sulfamate anion. Least preferred is the ammonium sulfate anion. However, all three anions provide the requisite thickness of at least 0.6 mil and the appropriate microhardness of at least 40 Rockwell C.

An additional component required is a reducing agent in an amount sufficient to prevent oxidation of $Fe^{2+}$ to $Fe^{3+}$. The reducing agent is one selected from the group consisting of ascorbic acid, boric acid, hydrazine, and sodium hypophosphite. Preferably, ascorbic acid is employed, ranging in concentration from about 1 to 30 g/L of plating solution, most preferably, about 1 to 2 g/L. Also, ascorbic acid may be combined with boric acid.

For plating iron onto the aluminum cathode, an iron anode is employed. The particulars regarding the iron anode are set forth in greater detail below. In order to promote dissolution of the iron anode, $Cl^-$ anion must be present. The source of the $Cl^-$ anion is a salt selected from the group consisting of NaCl, KCl, and $NH_4Cl$. Advantageously, NaCl is employed. The concentration of $Cl^-$ ranges from about 30 mg/L to 50 g/L of plating solution. The higher concentration is useful for operating at higher current densities.

Finally, a wetting agent is employed to prevent pitting of the aluminum cathode. This is necessary, since hydrogen evolution occurs during iron deposition on the aluminum cathode. The wetting agent prevents adherence of hydrogen bubbles on the aluminum cathode that would otherwise cause pitting of the aluminum part or cracking of the iron deposit due to embrittlement. The wetting agent preferably belongs to a surfactant family. Wetting agents such as sodium lauryl sulfate, polyethylene glycol (PEG), and other well-known surfactants may be employed in the practice of the present invention.

The concentration of the wetting agent ranges from about 0.1 to 20 mL/L. The upper limit is dictated by the fact that if the concentration of the wetting agent is too high, then organics from the wetting agent will be incorporated into the deposited iron film. Such incorporated organics tend to provide a higher hardness value, together with increased embrittlement.

The iron plating bath may also include appropriate addition agents, such as wetters, brighteners, and stress-reducing agents (such as saccharin, and the like), and other appropriate agents commonly employed in iron plating, to enhance the plating characteristics. A brightener permits use of higher current densities, which make it possible to plate the part faster. The composition and concentration of such addition agents are well-known in the art and hence do not form a part of this invention.

The iron plating bath of the invention is maintained at a pH of about 1 to 4, and preferably about 2 to 3. The pH of the plating solution appreciably influences the structure and mechanical properties of the iron deposit. Accordingly, this pH range provides the best combination of desired structural and mechanical properties of the iron deposit. The pH is adjusted with sulfuric acid, sulfamic acid, or ammonium hydroxide, as appropriate.

Plating is performed at a temperature ranging from about 40° to 80° C. The plating temperature affects the deposition rates and the internal stress of the iron deposits. Accordingly, this plating temperature range provides the best combination of desirable deposition rate and reduced internal stress of the iron deposit.

The iron electroplating bath is agitated, for example, by stirring, by mechanical agitation, by bubbling inert gas through the bath (e.g., $N_2$ gas), by plating parts rotating in the bath (e.g., a rotating electrode at a fixed speed), or by ultrasonic agitation. However, agitation using air should be avoided, since this results in excessive oxidation of Fe(II).

The anodes are cold rolled or electrolytic iron, at least 99.99% pure. A current of about 35 to 110 amps/ft$^2$ (376 to 1184 amps/m$^2$) is applied on the aluminum part, as cathode. Preferably, the current density is about 50 to 75 amps/ft$^2$ (538 to 807 amps/m$^2$), which provides the best combination of fast plating time consistent with good visual appearance of the iron plate.

The iron is plated to a thickness of about 0.0006 to 0.002 inch (0.0015 to 0.0051 cm). A thickness of less than about 0.0006 inch does not provide a sufficiently thick coating of iron for wear, while a thickness of greater than about 0.002 inch results in an iron layer that is too brittle. The preferred thickness for aluminum alloy pistons is about 0.001 inch (0.0025 cm) of iron per side.

A typical dwell time of about 20 minutes at 60 amps/ft$^2$ (646 amps/m$^2$) is used to obtain the desired thickness, although shorter or longer times at higher or lower currents, respectively, may be employed in the practice of the invention to obtain the desired thickness.

The iron-plated part is rinsed in cold running water and is finally immersed in a tin plating bath, such as a proprietary alkaline tin bath available from M&T Harshaw under the tradename AT 221-B, to form a tin "strike". The tin strike protects the underlying iron layer against rusting.

Tin is plated on to a thickness of about 0.000005 to 0.0001 inch (0.000012 to 0.00025 cm) following the manufacturer's directions. Preferably, a "strike", ranging in thickness from about 0.000007 to 0.000015 inch (0.0000178 to 0.000038 cm) is employed.

The tin plating bath is operated at 20 amps/ft$^2$ (215.3 amps/m$^2$). A typical dwell time for the "strike" thickness is about 30 seconds.

The tin-plated part is rinsed in cold running water and, after drying, is ready for assembly into the aluminum engine.

Use of the iron electroplating baths of the present invention permits formation of relatively thick iron layers, on the order of 0.6 to 2 mils, having a microhardness in the range of 40 to 54 Rockwell C. For use in automotive engines as an iron coating on aluminum alloy parts where wear characteristics are an important consideration, it has been determined that the best range of hardness values lies between about 40 to 45 Rockwell C. Employing a reducing agent (ascorbic acid) and wetting agent at the lower end of the above-mentioned concentration ranges helps to form iron coatings having a hardness within the desired range.

EXAMPLES

1. Solution Preparation.

All plating baths were prepared from reagent grade chemicals and deionized water. Ferrous ion concentrations varied from 0.65M to 2M. Ascorbic acid (1 to 30 g/L) was used as a reducing agent. A small amount of sodium chloride (30 to 50 ppm) was added to promote uniform corrosion of the iron anode. A wetting agent, sodium lauryl sulfate, having a concentration of 10 to 15 mL/L was added to prevent pitting of the aluminum cathodes. Plating baths were adjusted to desired pH level using sulfuric acid, sulfamic acid, or ammonium hydroxide. Solutions were filtered through a medium glass-fritted disk before use. Solution pH was measured with a Whatman model #PHE 250 pH meter which was calibrated daily with standard buffer solutions. Solution pH was monitored frequently and pH adjustment was made when necessary. Solution temperature was varied from 25° to 80° C. DC plating was carried out using a Terry Leighton Company power supply model 10–15.

Before plating, the aluminum substrate was prepared in a non-etching solution (Allied-Kelite CHEMIZID 740, followed by a cleaning process in proprietary ammonium bifluoride (Allied-Kelite proprietary solution ARP 28) and nitric acid solution. The plating process began by applying an immersion coating of zinc to prepare the aluminum surface for plating, a thin coating of electroless nickel (about 1 micrometer), and an electrodeposition step in ferrous ammonium sulfate, or ferrous sulfamate, or a mixture of ferrous ammonium sulfate/ferrous sulfamate baths.

2. Deposition with a Rotating Cylindrical Cathode.

Deposition on rotating cylindrical electrodes was carried out with an Armco iron anode and an aluminum cathode of length 1 inch and diameter 0.363 inch. Aluminum alloy parts, including 390 and 6061 alloys, were used.

Deposits were plated to thickness of about 18 to 36 micrometers (0.7 to 1.5 mil). After plating, the cathode was rinsed with distilled water and dried. The cathode was weighed before and after plating to determine cathode current efficiency (CE) viatotal deposit mass, and total coulombs used. Thickness distribution of deposits was measured by SEM and microhardness was measured with a Vickers microhardness tester (loads range from 25 to 100 g). Adhesion test was performed by using a simple tape test.

3. Solution Formulation.

Several examples are presented below to show the feasibility of using sulfamate electrolyte for hard iron plating in accordance with the teachings of the present invention.

EXAMPLES 1–3

Ferrous Sulfamate Bath

The use of sulfamate electrolyte is advantageous because of high solubility, bath stability, and the non-toxic nature of metal sulfamate. Sulfamate baths have also been reported to yield deposit with low internal stress.

Ferrous sulfamate baths were used at various concentrations, ranging from 1M to 2M. Plating baths usually contained ascorbic acid in the range of about 1 to 10 g/L and sodium chloride having a concentration of about 35 ppm. Surfactant was added (about 1 to 15 mL/L) as a wetting agent to prevent pitting.

Ferrous sulfamate baths yield adherent and smooth deposits at very high current densities (61 to 97 Amps/ft$^2$, Table I), and current densities of 110 Amps/ft$^2$ could be employed. Under these plating conditions, deposits showed no visible stress or crack. The appearance of deposits obtained from sulfamate bath were generally smooth with good adhesion. It was found that increasing current densities and increasing pH resulted in higher current efficiency (Table I). This bath gave iron deposit with relatively high hardness of 42 to 51 Rockwell C at a current density range of 61 to 97 Amps/ft$^2$.

TABLE I

SOLUTION COMPOSITIONS, PLATING CONDITIONS, AND TEST RESULTS - FERROUS SULFAMATE.

| SOLUTION COMPOSITION | PLATING CONDITIONS | CE % | THICKNESS, (MIL) | MICROHARDNESS, ROCKWELL C |
|---|---|---|---|---|
| Example 1: | | | | |
| 1M ferrous sulfamate<br>10 g/L ascorbic acid<br>10 mL/L wetting agent<br>35 ppm $Cl^-$ | pH = 2.1–2.2<br>T = 49° C. ± 1° C.<br>97 Amp/ft$^2$<br>t = 15 min | 80% | 0.6 | 42 |
| Example 2: | | | | |
| 1M ferrous sulfamate<br>1 g/L ascorbic acid<br>1 mL/L wetting agent<br>35 ppm $Cl^-$ | pH = 3.1<br>T = 60° C. ± °C.<br>61 Amp/ft$^2$<br>t = 20 min | 73% | 0.8 | 43 |
| Example 3: | | | | |
| 1M ferrous sulfamate<br>10 g/L ascorbic acid<br>14 mL/L wetting agent<br>35 ppm $Cl^-$ | pH = 2.6–2.7<br>T = 68° C. ± 1° C.<br>86 Amp/ft$^2$<br>t = 25 min | 69% | 1.2 | 51 |

EXAMPLES 4–10

Mixed Sulfamate and Sulfate Bath

A mixture of ferrous sulfamate and ferrous ammonium sulfate gave bright, smooth, and adherent deposits with no stress or crack at high current densities (Table II). This mixed bath yielded high cathode current efficiency (80 to 90%). The bath could be operated at high current density range (40 to 110 Amp/ft$^2$) at a wide range of solution temperature and pH (40° to 80° C., pH=2.5 to 4.0). The hardness of the deposit under the conditions listed in Table II was at acceptable values of 45 to 53 Rockwell C.

TABLE II

SOLUTION COMPOSITIONS, PLATING CONDITIONS, AND TEST RESULTS - MIXED FERROUS AMMONIUM SULFATE AND FERROUS SULFAMATE.

| SOLUTION COMPOSITION | PLATING CONDITIONS | CE % | THICKNESS, (MIL) | MICROHARDNESS, ROCKWELL C |
|---|---|---|---|---|
| Example 4: | | | | |
| 1M ferrous sulfamate<br>0.68M fer. amm. sulfate<br>10 g/L ascorbic acid<br>20 mL/L wetting agent<br>35 ppm $Cl^-$ | pH = 3.4<br>T = 73° C. ± 1° C.<br>60 Amp/ft$^2$ | 80% | 1.1 | 48 |
| Example 5: | | | | |
| 1M ferrous sulfamate<br>0.68M fer. amm. sulfate<br>10 g/L ascorbic acid<br>20 mL/L wetting agent<br>35 ppm $Cl^-$ | pH = 3.6<br>T = 75° C. ± 1° C.<br>89 Amp/ft$^2$<br>t = 15 min | 83% | 1 | 52 |
| Example 6: | | | | |
| 1M ferrous sulfamate<br>0.68M fer. amm. sulfate<br>10 g/L ascorbic acid<br>20 mL/L wetting agent<br>35 ppm $Cl^-$ | pH = 3.6<br>T = 64° C. ± 1° C.<br>50 Amp/ft$^2$<br>t = 20 min | 75% | 1.2 | 53 |
| Example 7: | | | | |
| 0.80M ferrous sulfamate<br>0.47M fer. amm. sulfate<br>12 g/L ascorbic acid<br>16 mL/L wetting agent<br>35 ppm $Cl^-$ | pH = 3.2<br>T = 70° C. ± 1° C.<br>46 Amp/ft$^2$<br>t = 25 min | 64% | 0.85 | 50 |
| Example 8: | | | | |
| 0.80M ferrous sulfamate<br>0.47M fer. amm. sulfate<br>12 g/L ascorbic acid<br>16 mL/L wetting agent<br>35 ppm $Cl^-$ | pH = 3.7<br>T = 64° ± 1° C.<br>60 Amp/ft$^2$<br>t = 20 min | 85% | 1.1 | 52 |
| Example 9: | | | | |
| 0.80M ferrous sulfamate<br>0.47M fer. amm. sulfate<br>12 g/L ascorbic acid<br>16 mL/L wetting agent<br>35 ppm $Cl^-$ | pH = 3.7<br>T = 60° ± 1° C.<br>76 Amp/ft$^2$<br>t = 15 min | 90% | 1.10 | 52 |
| Example 10: | | | | |
| 0.80M ferrous sulfamate<br>0.47M fer. amm. sulfate<br>12 g/L ascorbic acid<br>16 mL/L wetting agent<br>35 ppm $Cl^-$ | pH = 3.7<br>T = 76° ± 1° C.<br>47 Amp/ft$^2$<br>t = 20 min | 85% | 0.75 | 45 |

EXAMPLES 11–16

Ferrous Ammonium Sulfate and Ferrous Sulfate Baths

Ferrous ammonium sulfate baths were used at various concentrations, ranging from 0.65M to 2M. Plating baths contained between 3 to 30 g/L ascorbic acid and 35 ppm sodium chloride. Hull cell experiments indicated that a higher concentration of ferrous ions (between 1.3 to 2M) allowed the use of higher current densities for deposition of smooth and adherent deposits.

Table III shows various conditions in which acceptable hardnesses of thick (0.8 to 1.6 mils, or 20 to 40 micrometers) iron deposits were obtained. Appearance of deposits from baths containing 1.3M to 2M ferrous ions was generally superior to those produced in bath containing 0.65 to 1M ferrous ions.

Mixed ferrous ammonium sulfate and ferrous sulfate baths were also used. These baths gave bright and smooth deposits at current densities of 33 to 35 Amp/ft$^2$ with very little or no stress cracking (Table III). The hardnesses of the deposits under these conditions were at acceptable values of 46 to 54 Rockwell C.

TABLE III

SOLUTION COMPOSITIONS, PLATING CONDITIONS, AND TEST RESULTS - AMMONIUM SULFATE.

| SOLUTION COMPOSITION | PLATING CONDITIONS | CE % | THICKNESS, (MIL) | MICROHARDNESS, ROCKWELL C |
|---|---|---|---|---|
| Example 11: | | | | |
| 1.5M fer. amm. sulfate<br>30 g/L ascorbic acid<br>14 mL/L wetting agent<br>35 ppm $Cl^-$ | pH = 2.5–2.8<br>T = 72°–74° C.<br>70 Amp/ft$^2$<br>t = 30 min | 65% | 1.1 | 41 |
| Example 12: | | | | |
| 1.70M fer. amm. sulfate<br>30 g/L ascorbic acid<br>14 mL/L wetting agent<br>35 ppm $Cl^-$ | pH = 3.3–3.4<br>T = 72°–75° C.<br>70 Amp/ft$^2$<br>t = 50 min | 75% | 1.6 | 46 |
| Example 13: | | | | |
| 1.70M fer. amm. sulfate<br>20 g/L ascorbic acid<br>14 mL/L wetting agent<br>35 ppm $Cl^-$ | pH = 2.8–3.2<br>T = 78°–80° C.<br>44 Amp/ft$^2$<br>t = 20 min | 68% | 0.8 | 46 |
| Example 14: | | | | |
| 2M fer. amm. sulfate<br>30 g/L ascorbic acid<br>14 mL/L wetting agent<br>35 ppm $Cl^-$<br>100 g/L $K_2SO_4$* | pH = 2.9–3.3<br>T = 78°–80° C.<br>80 Amp/ft$^2$<br>t = 20 min | 74% | 0.95 | 46 |
| Example 15: | | | | |
| 2M fer. amm. sulfate<br>30 g/L ascorbic acid<br>14 mL/L wetting agent<br>35 ppm $Cl^-$ | pH = 2.8–3.2<br>T = 78°–80° C.<br>80 Amp/ft$^2$<br>t = 20 min | 74% | 1.1 | 54 |
| Example 16: | | | | |
| 1M fer. amm. sulfate<br>0.48M ferrous sulfate<br>0.24M $K_2SO_4$*<br>3 g/L ascorbic acid<br>10 mL/L wetting agent<br>35 ppm $Cl^-$ | pH = 3.5–4.0<br>T = 65°–70° C.<br>35 Amp/ft$^2$<br>t = 40 min | 85% | 1.4 | 50 |

Note: *$K_2SO_4$ is a conducting salt, used to improve the conductivity of the plating solution.

Thus, there has been disclosed iron electroplating bath compositions for plating iron on aluminum and aluminum alloy parts, such as pistons, and methods for performing the electroplating. It will be readily appreciated by those skilled in this art that various changes and modifications of an obvious nature may be made, and all such changes and modifications are considered to fall within the scope of the invention, as defined by the appended claims.

What is claimed is:

1. A ferrous electroplating solution for plating an aluminum cathode with an iron layer in the presence of an iron anode, said iron layer having a micro-hardness of at least about 40 Rockwell C, said ferrous electroplating solution consisting of:

(a) ferrous iron having a concentration ranging from about 0.65 to 2.0 Moles of $Fe^{2+}$ per liter of electroplating solution;

(b) at least one anion selected from the group consisting of sulfamate and ammonium sulfate and associated with said $Fe^{2+}$ ions;

(c) a reducing agent in an amount sufficient to prevent oxidation of $Fe^{2+}$ to $Fe^{3+}$;

(d) $Cl^-$ anion in an amount sufficient to promote dissolution of said iron anode; and (e) a wetting agent in an amount sufficient to prevent pitting of said aluminum cathode.

2. The ferrous electroplating solution of claim 1 wherein said concentration of said ferrous ion ranges from about 1.4 to 2.0 moles of $Fe^{2+}$ ion per liter of electroplating solution.

3. The ferrous electroplating solution of claim 1 wherein said reducing agent consists essentially of at least one compound selected from the group consisting of ascorbic acid, boric acid, hydrazine, and sodium hypophosphite.

4. The ferrous electroplating solution of claim 3 wherein said reducing agent consists essentially of ascorbic acid, having a concentration within the range of about 1 to 30 g/L of electroplating solution.

5. The ferrous electroplating solution of claim 1 wherein said $Cl^-$ anion is present in an amount ranging from about 30 mg/L to 50 g/L of electroplating solution.

6. The ferrous electroplating solution of claim 1 wherein said wetting agent is selected from the group consisting of sodium lauryl sulfate and polyethylene glycol.

7. The ferrous electroplating solution of claim 6 wherein said wetting agent is present in an amount ranging from about 0.1 to 20 mL/L of electroplating solution.

8. The ferrous electroplating solution of claim 1 wherein said solution has a pH ranging from about 2 to 4.

9. A method of electroplating an iron layer from an iron anode onto aluminum-containing cathode in a ferrous electroplating solution, said iron layer having a microhardness of at least about 40 Rockwell C, said method comprising:

(a) providing said ferrous electroplating solution, said solution comprising (1) ferrous iron having a concentration ranging from about 0.65 to 2.0 Moles of $Fe^{2+}$ per liter of electroplating solution, (2) at least one anion selected from the group consisting of sulfamate and ammonium sulfate and associated with said $Fe^{2+}$ ions, (3) a reducing agent in an amount sufficient to prevent oxidation of $Fe^{2+}$ to $Fe^{3+}$, (4) $Cl^-$ anion in an amount sufficient to promote dissolution of said iron anode, and (5) a wetting agent in an amount sufficient to prevent pitting of said aluminum cathode;

(b) immersing said iron anode and said aluminum-containing cathode in said ferrous electroplating solution; and (c) conducting said electroplating of said iron at a current density ranging from about 35 to 110 Amp/ft$^2$ for a time sufficient to plate a layer of iron on said aluminum-containing cathode to a thickness ranging from about 0.6 to 2 mils.

10. The method of claim 9 wherein said concentration of said ferrous ion ranges from about 1.4 to 2.0 moles of $Fe^{2+}$ ion per liter of electroplating solution.

11. The method of claim 9 wherein said reducing agent consists essentially of at least one compound selected from the group consisting of ascorbic acid, boric acid, hydrazine, and sodium hypophosphite.

12. The method of claim 11 wherein said reducing agent consists essentially of ascorbic acid, having a concentration within the range of about 1 to 30 g/L of electroplating solution.

13. The method of claim 9 wherein said $Cl^-$ anion is present in an amount ranging from about 30 mg/L to 50 g/L of electroplating solution.

14. The method of claim 9 wherein said wetting agent is selected from the group consisting of sodium lauryl sulfate and polyethylene glycol.

15. The method of claim 14 wherein said wetting agent is present in an amount ranging from about 0.1 to 20 mL/L of electroplating solution.

16. The method of claim 9 wherein said solution has a pH ranging from about 2 to 4.

17. The method of claim 9 wherein said solution is maintained at a temperature ranging from about 40° to 80° C.

18. The method of claim 9 wherein said solution is agitated during plating.

19. The method of claim 9 wherein said aluminum-containing cathode is plated with a layer of nickel from an electroless nickel plating bath prior to said electroplating of iron.

20. A ferrous electroplating solution for plating an aluminum cathode with iron in the presence of an iron anode comprising:

(a) ferrous iron having a concentration ranging from about 0.65 to 2.0 Moles of $Fe^{2+}$ per liter of electroplating solution;

(b) an ammonium sulfate anion associated with said $Fe^{2+}$ ions;

(c) a reducing agent in an amount sufficient to prevent oxidation of $Fe^{2+}$ to $Fe^{3+}$, said reducing agent selected from the group consisting of ascorbic acid, hydrazine, and sodium hypophosphite;

(d) $Cl^-$ anion in an amount sufficient to promote dissolution of said iron anode; and (e) polyethylene glycol in an amount sufficient to prevent pitting of said aluminum cathode.

21. A method of electroplating an iron layer from an iron anode onto an aluminum-containing cathode in a ferrous electroplating solution, said iron layer having a microhardness of at least about 40 Rockwell, C, said method comprising:

(a) providing said ferrous electroplating solution, said solution comprising (1) ferrous iron having a concentration ranging from about 0.65 to 2.0 Moles of $Fe^{2+}$ per liter of electroplating solution, (2) an ammonium sulfate anion associated with said $Fe^{2+}$ ions, (3) a reducing agent in an amount sufficient to prevent oxidation of $Fe^{2+}$ to $Fe^{3+}$, said reducing agent selected from the group consisting of ascorbic acid, hydrazine, and sodium hypophosphite, (4) $Cl^-$ anion in an amount sufficient to promote dissolution of said iron anode, and (5) polyethylene glycol in an amount sufficient to prevent pitting of said aluminum cathode;

(b) immersing said iron anode and said aluminum cathode in said ferrous electroplating solution; and (c) conducting said electroplating of said iron at a current density ranging from about 35 to 110 Amp-Ft$^2$ for a time sufficient to plate a layer of iron on said aluminum cathode to a thickness ranging from about 0.6 to 2 mils.

22. A ferrous electroplating solution for plating an aluminum cathode with an iron layer in the presence of an iron anode, said iron layer having a micro-hardness of at least about 40 Rockwell C, said ferrous electroplating solution comprising:

(a) ferrous iron having a concentration ranging from about 0.65 to 2.0 Moles of $Fe^{2+}$ per liter of electroplating solution;

(b) at least one anion selected from the group consisting of sulfamate and ammonium sulfate and associated with said $Fe^{2+}$ ions;

(c) a reducing agent in an amount sufficient to prevent oxidation of $Fe^{2+}$ to $Fe^{3+}$, said reducing agent consisting essentially of ascorbic acid, having a concentration within the range of about 1 to 30 g/L of electroplating solution;

(d) $Cl^-$ anion in an amount sufficient to promote dissolution of said iron anode; and (e) a wetting solution in an amount sufficient to prevent pitting of said aluminum cathode.

* * * * *